US009535380B2

(12) United States Patent
Shimokawa et al.

(10) Patent No.: US 9,535,380 B2
(45) Date of Patent: Jan. 3, 2017

(54) FIXING DEVICE AND IMAGE FORMING APPARATUS

(71) Applicants: Toshihiko Shimokawa, Kanagawa (JP); Yutaka Ikebuchi, Kanagawa (JP); Hiroshi Yoshinaga, Chiba (JP); Takayuki Seki, Kanagawa (JP); Yuji Arai, Kanagawa (JP); Ryuuichi Mimbu, Kanagawa (JP); Shuntaro Tamaki, Kanagawa (JP); Kazuya Saito, Kanagawa (JP); Shuutaroh Yuasa, Kanagawa (JP); Masaaki Yoshikawa, Tokyo (JP); Takuya Seshita, Kanagawa (JP); Hajime Gotoh, Kanagawa (JP); Takahiro Imada, Kanagawa (JP); Kensuke Yamaji, Kanagawa (JP); Akira Suzuki, Tokyo (JP)

(72) Inventors: Toshihiko Shimokawa, Kanagawa (JP); Yutaka Ikebuchi, Kanagawa (JP); Hiroshi Yoshinaga, Chiba (JP); Takayuki Seki, Kanagawa (JP); Yuji Arai, Kanagawa (JP); Ryuuichi Mimbu, Kanagawa (JP); Shuntaro Tamaki, Kanagawa (JP); Kazuya Saito, Kanagawa (JP); Shuutaroh Yuasa, Kanagawa (JP); Masaaki Yoshikawa, Tokyo (JP); Takuya Seshita, Kanagawa (JP); Hajime Gotoh, Kanagawa (JP); Takahiro Imada, Kanagawa (JP); Kensuke Yamaji, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/278,252

(22) Filed: May 15, 2014

(65) Prior Publication Data

US 2014/0356037 A1 Dec. 4, 2014

(30) Foreign Application Priority Data

May 29, 2013 (JP) ..... 2013-112817
Mar. 28, 2014 (JP) ..... 2014-069372

(51) Int. Cl.
*G03G 15/20* (2006.01)

(52) U.S. Cl.
CPC ..... *G03G 15/2053* (2013.01); *G03G 15/2017* (2013.01); *G03G 15/2039* (2013.01);
(Continued)

(58) Field of Classification Search
CPC ..... G03G 15/2042; G03G 15/2039; G03G 15/2082; G03G 15/2078; G03G 15/2053; G03G 15/2017
(Continued)

(56) References Cited

U.S. PATENT DOCUMENTS 4,442,374 A * 4/1984 Morris ..... G03G 15/2003 313/1
2007/0059001 A1* 3/2007 Matsuura ..... G03G 15/2042 399/45
(Continued)

FOREIGN PATENT DOCUMENTS

CN 102063039 A 5/2011
CN 102135748 A 7/2011
(Continued)

OTHER PUBLICATIONS

U.S. Appl. No. 14/277,477, filed May 14, 2014, Shimokawa, et al.
(Continued)

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

A fixing device includes a fixing rotator, a first heat generator and a second heat generator that heat the fixing rotator, and a support disposed inside the fixing rotator. A reflector, interposed between the support and each of the first heat generator and the second heat generator, reflects light radiated from the first heat generator and the second heat generator toward the fixing rotator. The reflector includes a body mounted on the support and a shield portion projecting from the body toward the first heat generator and the second heat generator to shield the fixing rotator from the first heat generator and the second heat generator. An electric circuit is connected to the first heat generator and the second heat generator. A heat generation restrainer is provided in the electric circuit to restrict heat generation in the electric circuit.

25 Claims, 8 Drawing Sheets

(52) U.S. Cl.
CPC ..... *G03G 15/2042* (2013.01); *G03G 15/2078* (2013.01); *G03G 15/2082* (2013.01); *G03G 2215/2035* (2013.01)

(58) Field of Classification Search
USPC ..... 399/329
See application file for complete search history.

(56) References Cited

U.S. PATENT DOCUMENTS

2007/0292175 A1 12/2007 Shinshi
2008/0298862 A1 12/2008 Shinshi
2010/0033093 A1* 2/2010 Leonard ..... H01J 1/16 313/623
2010/0067929 A1* 3/2010 Seki ..... G03G 15/2042 399/45
2011/0052285 A1* 3/2011 Fukuhata ..... G03G 15/2053 399/333
2011/0064437 A1* 3/2011 Yamashina et al. ..... 399/67
2011/0064443 A1* 3/2011 Iwaya ..... G03G 15/2053 399/69
2011/0116848 A1* 5/2011 Yamaguchi ..... G03G 15/2064 399/329
2011/0182634 A1* 7/2011 Ishigaya et al. ..... 399/328
2011/0217057 A1* 9/2011 Yoshinaga ..... G03G 15/20 399/33
2011/0229225 A1* 9/2011 Ishii et al. ..... 399/329
2011/0274453 A1* 11/2011 Shimokawa et al. ..... 399/45
2012/0308253 A1* 12/2012 Kurata ..... G03G 15/2042 399/69
2013/0183072 A1* 7/2013 Hase et al. ..... 399/329
2013/0209147 A1 8/2013 Ogawa et al.
2014/0016971 A1 1/2014 Arai et al.
2014/0016972 A1 1/2014 Seshita et al.
2014/0072355 A1 3/2014 Tamaki et al.
2014/0079424 A1 3/2014 Ikebuchi et al.
2014/0079453 A1 3/2014 Arai et al.
2014/0079455 A1 3/2014 Seki et al.

FOREIGN PATENT DOCUMENTS

JP H10-149871 A 6/1998
JP 2004-264785 A 9/2004
JP 2004-286922 10/2004
JP 2005-215550 A 8/2005
JP 2007-025101 A 2/2007
JP 2007-233011 9/2007
JP 2007-334205 12/2007
JP 2008-139779 A 6/2008
JP 2009-003410 1/2009
JP 2009-180789 8/2009
JP 2010-066583 3/2010
JP 2010-078839 A 4/2010
JP 2010-079309 4/2010
JP 4454582 4/2010
JP 2011-022430 A 2/2011
JP 2012-098362 5/2012
JP 2012098362 A * 5/2012
JP 2012-123313 A 6/2012
WO WO 2005/015320 A1 2/2005

OTHER PUBLICATIONS

U.S. Appl. No. 14/277,477, filed May 14, 2014.
U.S. Appl. No. 14/175,570, filed Feb. 7, 2014.
U.S. Appl. No. 14/141,351, filed Dec. 26, 2013.
U.S. Appl. No. 14/190,048, filed Feb. 25, 2014.
U.S. Appl. No. 14/141,334, filed Dec. 26, 2013.
U.S. Appl. No. 14/143,253, filed Dec. 30, 2013.
U.S. Appl. No. 14/161,662, filed Jan. 22, 2014.
U.S. Appl. No. 14/203,764, filed Mar. 11, 2014.
U.S. Appl. No. 14/193,273, filed Feb. 28, 2014.
Office Action issued in Chinese Patent Application No. 201410215079.X on Feb. 14, 2016.
Office Action issued in Japanese Patent Application No. 2015-101257 on Feb. 23, 2016.

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-112817, filed on May 29, 2013, and 2014-069372, filed on Mar. 28, 2014, in the Japanese Patent Office, the entire disclosure of each of which is hereby incorporated by reference herein.

BACKGROUND

Technical Field

Exemplary aspects of the present invention relate to a fixing device and an image forming apparatus, and more particularly, to a fixing device for fixing an image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing roller heated by a heater and a pressure roller pressed against the fixing roller to form a fixing nip therebetween. As a recording medium bearing a toner image is conveyed through the fixing nip, the fixing roller and the pressure roller apply heat and pressure to the recording medium, melting and fixing the toner image on the recording medium.

Instead of the fixing roller, the fixing device may include a fixing belt having a thermal capacity smaller than that of the fixing roller and heated by a heater lamp. Instead of the fixing belt, the fixing device may include a fixing film heated by a ceramic heater.

The fixing belt is requested to be heated quickly to shorten a first print time taken to output the recording medium bearing the fixed toner image upon receipt of a print job. Additionally, as the image forming apparatus conveys an increased amount of recording media at high speed, the fixing belt is requested to overcome shortage of heat.

On the other hand, since the fixing film is heated by the ceramic heater situated at the fixing nip, the fixing film is heated insufficiently at an entry to the fixing nip, resulting in faulty fixing. Accordingly, the fixing film is requested to overcome shortage of heat at the entry to the fixing nip.

To address those requests, the fixing device may include a metal thermal conductor as shown in FIG. 1. FIG. 1 is a vertical sectional view of a fixing device 20R1 incorporating a tubular, metal thermal conductor 200 disposed inside an endless belt 101. A heater 300 is disposed inside the metal thermal conductor 200. A pressure roller 400 is pressed against the metal thermal conductor 200 via the endless belt 101 to form a fixing nip N between the pressure roller 400 and the endless belt 101. As the pressure roller 400 rotates clockwise in FIG. 1, the endless belt 101 rotates counterclockwise in FIG. 1 in accordance with rotation of the pressure roller 400, thus conveying a recording medium P bearing a toner image in a recording medium conveyance direction D1. The metal thermal conductor 200 guides the endless belt 101 sliding thereover. The heater 300 heats the metal thermal conductor 200 which in turn heats the endless belt 101, thus heating the endless belt 101 entirely. Since the tubular, metal thermal conductor 200 is disposed opposite the endless belt 101 throughout the entire circumferential span of the endless belt 101, the metal thermal conductor 200 heats the endless belt 101 quickly, thus shortening the first print time and overcoming shortage of heat.

In order to shorten the first print time and save energy further, the endless belt 101 heated by the heater 300 directly, not through the metal thermal conductor 200, is proposed as shown in FIG. 2. FIG. 2 is a vertical sectional view of a fixing device 20R2 incorporating the endless belt 101 heated by the heater 300 directly. As shown in FIG. 2, instead of the metal thermal conductor 200 depicted in FIG. 1, a nip formation plate 500 disposed inside the endless belt 101 presses against the pressure roller 400 via the endless belt 101 to form the fixing nip N between the endless belt 101 and the pressure roller 400. Since the heater 300 heats the endless belt 101 directly at a position other than the fixing nip N, the heater 300 heats the endless belt 101 effectively, shortening the first print time at reduced manufacturing costs while saving energy. A stainless steel support 600 supports the nip formation plate 500 to enhance mechanical strength of the nip formation plate 500 against pressure from the pressure roller 400.

In addition to the heater 300 heating the endless belt 101 directly as shown in FIG. 2, a reflector may be situated inside the endless belt 101 to reflect light irradiating the reflector toward the endless belt 101, thus heating the endless belt 101 effectively and quickly.

In order to downsize the fixing device and decrease the thermal capacity of the fixing device, the endless belt 101 may have a decreased loop diameter. The decreased loop diameter of the endless belt 101 causes the reflector to be disposed opposite the heater 300 with a decreased interval therebetween. Hence, the reflector is susceptible to heat from the heater 300. As the temperature of the entire reflector increases, the temperature of a reflection face of the reflector increases, resulting in tarnishing of the reflection face of the reflector due to thermal oxidation of a material treated with deposition on the reflection face.

Alternatively, the fixing device may include a plurality of heaters: a center heater including a filament that heats a center of the fixing belt in an axial direction thereof and a lateral end heater including a filament that heats each lateral end of the fixing belt in the axial direction thereof. The center heater and the lateral end heater are turned on and off according to the size of the recording medium, preventing overheating of each lateral end of the fixing belt in the axial direction thereof where the recording medium is not conveyed. Additionally, the center heater and the lateral end heater are turned on and off based on the temperature of the center and the lateral end of the fixing belt in the axial direction thereof that is detected by a plurality of sensors disposed opposite the center and the lateral end of the fixing belt.

However, the center heater and the lateral end heater may generate heat unnecessarily at a section where heating is not required, for example, a connection portion connecting the filament of the center heater and the filament of the lateral end heater. Accordingly, heat may be conducted from the connection portion to the reflector, overheating the reflector.

SUMMARY

This specification describes below an improved fixing device. In one exemplary embodiment, the fixing device includes a fixing rotator rotatable in a predetermined direction of rotation, a first heat generator disposed opposite the fixing rotator to heat the fixing rotator and spanning a first heating span in an axial direction of the fixing rotator, and a second heat generator disposed opposite the fixing rotator to heat the fixing rotator and spanning a second heating span in the axial direction of the fixing rotator that is different from the first heating span. A support is disposed inside the fixing rotator. An opposed rotator contacts the fixing rotator to form a fixing nip therebetween, through which a recording medium bearing a toner image is conveyed. A reflector is interposed between the support and each of the first heat generator and the second heat generator to reflect light radiated from the first heat generator and the second heat generator toward the fixing rotator and extending in a direction perpendicular to the direction of rotation of the fixing rotator. The reflector includes a body mounted on the support and a shield portion projecting from the body toward the first heat generator and the second heat generator to shield the fixing rotator from the first heat generator and the second heat generator. An electric circuit is connected to the first heat generator and the second heat generator. A heat generation restrainer is provided in the electric circuit to restrict heat generation in the electric circuit.

This specification further describes an improved image forming apparatus. In one exemplary embodiment, the image forming apparatus includes an image forming device to form a toner image and the fixing device described above to fix the toner image on a recording medium.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
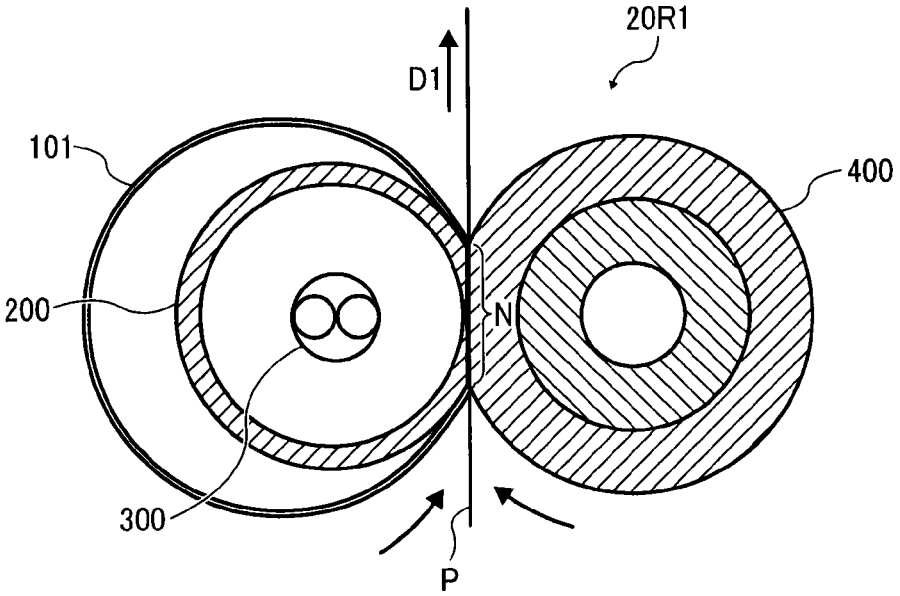
FIG. 1 RELATED ART
FIG. 1 is a schematic vertical sectional view of a related-art fixing device.
Figure 2:
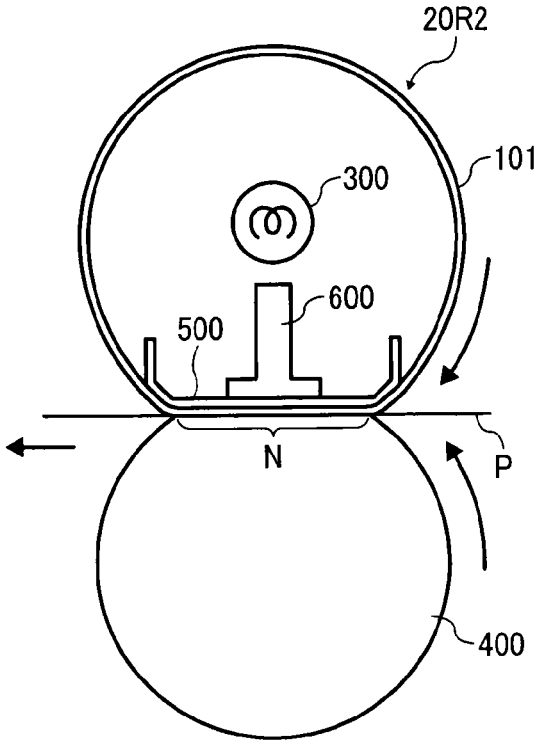
FIG. 2 RELATED ART
FIG. 2 is a schematic vertical sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
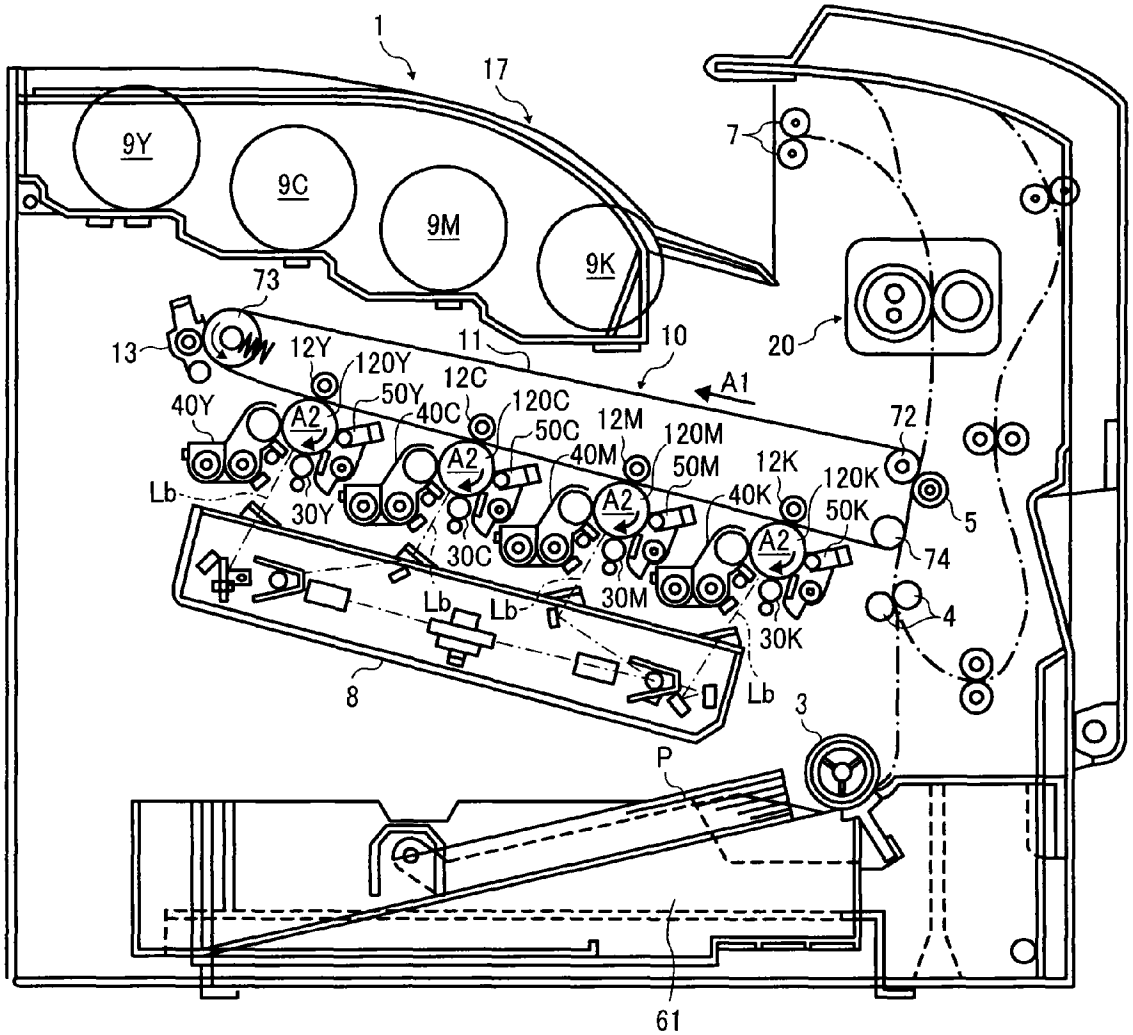
FIG. 3 is a schematic vertical sectional view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on recording media by electrophotography.

The image forming apparatus 1 has a tandem structure in which four photoconductive drums 120Y, 120C, 120M, and 120K serving as image carriers for bearing yellow, cyan, magenta, and black toner images, respectively, are aligned in tandem.

In a primary transfer process, the yellow, cyan, magenta, and black toner images formed on the photoconductive drums 120Y, 120C, 120M, and 120K, respectively, are primarily transferred onto a transfer belt 11 being disposed opposite the photoconductive drums 120Y, 120C, 120M, and 120K and rotating in a rotation direction A1 successively such that the yellow, cyan, magenta, and black toner images are superimposed on a same position on the transfer belt 11. In a secondary transfer process, the yellow, cyan, magenta, and black toner images superimposed on the transfer belt 11 are secondarily transferred onto a recording medium P (e.g., a sheet) collectively.

The photoconductive drums 120Y, 120C, 120M, and 120K are surrounded by devices that form the yellow, cyan, magenta, and black toner images as the photoconductive drums 120Y, 120C, 120M, and 120K rotate in a rotation direction A2, respectively. Taking the photoconductive drum 120K for forming the black toner image, for example, the photoconductive drum 120K is surrounded by a charger 30K, a development device 40K, a primary transfer roller 12K, and a cleaner 50K in the rotation direction A2 of the photoconductive drum 120K, which perform image forming processes for forming the black toner image on the photoconductive drum 120K. Below the photoconductive drum 120K is an optical writer 8 that conducts optical writing on the photoconductive drum 120K to form an electrostatic latent image thereon after the charger 30K charges the photoconductive drum 120K. The development device 40K visualizes the electrostatic latent image into a black toner image with black toner supplied from a toner bottle 9K. Similarly, the optical writer 8 forms electrostatic latent images on the photoconductive drums 120Y, 120C, and 120M charged by chargers 30Y, 30C, and 30M, respectively; development devices 40Y, 40C, and 40M visualize the electrostatic latent images into yellow, cyan, and magenta toner images with yellow, cyan, and magenta toners supplied from toner bottles 9Y, 9C, and 9M, respectively.

As the transfer belt 11 rotates in the rotation direction A1, the yellow, cyan, magenta, and black toner images formed on the photoconductive drums 120Y, 120C, 120M, and 120K are primarily transferred onto the transfer belt 11 such that the yellow, cyan, magenta, and black toner images are superimposed on the same position on the transfer belt 11. For example, primary transfer rollers 12Y, 12C, 12M, and 12K disposed opposite the photoconductive drums 120Y, 120C, 120M, and 120K via the transfer belt 11, respectively, apply a transfer bias to the photoconductive drums 120Y, 120C, 120M, and 120K successively in this order in the rotation direction A1 of the transfer belt 11.

Each of the photoconductive drums 120Y, 120C, 120M, and 120K is accommodated in a process cartridge. The photoconductive drums 120Y, 120C, 120M, and 120K are aligned in this order in the rotation direction A1 of the transfer belt 11. The photoconductive drum 120K, the charger 30K, the development device 40K, and the cleaner 50K constitute an image forming station that forms the black toner image. Similarly, the photoconductive drums 120Y, 120C, and 120M, the chargers 30Y, 30C, and 30M, the development devices 40Y, 40C, and 40M, and cleaners 50Y, 50C, and 50M constitute image forming stations that form the yellow, cyan, and magenta toner images, respectively.

Above the photoconductive drums 120Y, 120C, 120M, and 120K is a transfer belt unit 10 configured to perform the primary transfer process described above and constructed of the primary transfer rollers 12Y, 12C, 12M, and 12K disposed opposite the photoconductive drums 120Y, 120C, 120M, and 120K via the transfer belt 11 and the transfer belt 11 stretched taut across a plurality of rollers 72, 73, and 74.

As a secondary transfer roller 5 rotates in accordance with rotation of the transfer belt 11 rotating in the rotation direction A1 to convey a recording medium P through a secondary transfer nip formed between the secondary transfer roller 5 and the transfer belt 11, the secondary transfer roller 5 secondarily transfers the yellow, cyan, magenta, and black toner images superimposed on the transfer belt 11 onto the recording medium P collectively.

In addition to the process cartridges and the transfer belt unit 10, the image forming apparatus 1 further includes the optical writer 8 (e.g., an optical scanner) situated below and disposed opposite the four image forming stations and a cleaner 13 that cleans the transfer belt 11.

The optical writer 8 includes a semiconductor laser serving as a light source, a coupling lens, an f-θ lens, a troidal lens, a deflection mirror, and a polygon mirror. The optical writer 8 emits laser beams Lb corresponding to yellow, cyan, magenta, and black image data onto the photoconductive drums 120Y, 120C, 120M, and 120K, forming electrostatic latent images on the photoconductive drums 120Y, 120C, 120M, and 120K, respectively.

The image forming apparatus 1 further includes a recording medium feeder 61 and a registration roller pair 4. The recording medium feeder 61 loads a plurality of recording media P to be conveyed to the secondary transfer nip and includes a feed roller 3 that feeds an uppermost recording medium P of the plurality of recording media P to the registration roller pair 4. The registration roller pair 4 conveys the recording medium P to the secondary transfer nip formed between the secondary transfer roller 5 and the transfer belt 11 at a proper time when the yellow, cyan, magenta, and black toner images superimposed on the transfer belt 11 reach the secondary transfer nip. The image forming apparatus 1 further includes a sensor that detects a leading edge of the recording medium P as it reaches the registration roller pair 4.

As the yellow, cyan, magenta, and black toner images are secondarily transferred from the transfer belt 11 onto the recording medium P collectively, a color toner image is formed on the recording medium P. The recording medium P bearing the color toner image is conveyed to a fixing device 20 employing a thermal roller fixing method where the color toner image is fixed on the recording medium P. The recording medium P bearing the fixed color toner image is discharged onto an outside of the image forming apparatus 1, that is, an output tray 17, through an output roller pair 7.

Figure 4:
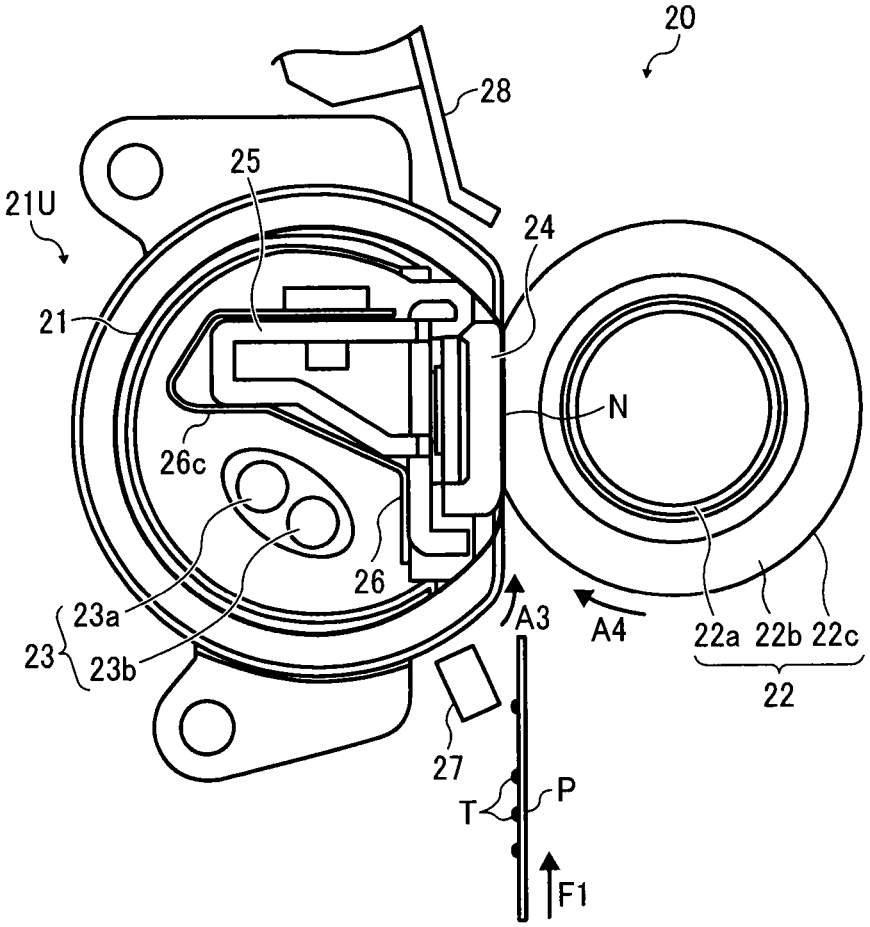
FIG. 4 is a vertical sectional view of a fixing device incorporated in the image forming apparatus shown in FIG. 3.

With reference to FIG. 4, a description is provided of a construction of the fixing device 20 incorporated in the image forming apparatus 1 described above.

FIG. 4 is a vertical sectional view of the fixing device 20. As shown in FIG. 4, the fixing device 20 (e.g., a fuser) includes a flexible, endless fixing belt 21 formed into a loop and serving as a fixing rotator rotatable in a rotation direction A3; a pressure roller 22 serving as an opposed rotator disposed opposite the fixing belt 21 and rotatable in a rotation direction A4 counter to the rotation direction A3 of the fixing belt 21; and a nip formation pad 24 disposed inside the loop formed by the fixing belt 21. The pressure roller 22 is pressed against the nip formation pad 24 via the fixing belt 21 to form a fixing nip N between the fixing belt 21 and the pressure roller 22, through which a recording medium P bearing a toner image T is conveyed.

The fixing device 20 further includes a heater pair 23 disposed opposite the fixing belt 21 to heat the fixing belt 21 at a position other than the fixing nip N; a stay 25 serving as a support disposed inside the loop formed by the fixing belt 21 and contacting and supporting the nip formation pad 24; a reflector 26 disposed inside the loop formed by the fixing belt 21 to reflect light radiated from the heater pair 23 thereto toward the fixing belt 21; a temperature sensor 27 serving as a temperature detector disposed opposite an outer circumferential surface of the fixing belt 21 to detect the temperature of the fixing belt 21; and a separator 28 disposed downstream from the fixing nip N in a recording medium conveyance direction F1 to separate the recording medium P discharged from the fixing nip N from the fixing belt 21. The fixing device 20 further includes a pressurization assembly that presses the pressure roller 22 against the nip formation pad 24 via the fixing belt 21. The fixing belt 21 and the components disposed inside the loop formed by the fixing belt 21, that is, the heater pair 23, the nip formation pad 24, the stay 25, and the reflector 26, may constitute a belt unit 21U separably coupled with the pressure roller 22.

A detailed description is now given of a construction of the fixing belt 21.

The fixing belt 21 is a thin, flexible endless belt or film. The fixing belt 21 is constructed of a base layer and an outer surface release layer. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressure roller 22 against the nip formation pad 24 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a predetermined length in the recording medium conveyance direction F1.

A driver (e.g., a motor) disposed inside the image forming apparatus 1 depicted in FIG. 3 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

As shown in FIG. 4, according to this exemplary embodiment, the pressure roller 22 is a solid roller. Alternatively, the pressure roller 22 may be a hollow roller. In this case, a heater that generates radiation heat such as a halogen heater may be disposed inside the hollow roller. If the pressure roller 22 does not incorporate the elastic layer 22*b*, the pressure roller 22 has a decreased thermal capacity that improves fixing property of being heated to a predetermined fixing temperature quickly. However, as the pressure roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the pressure roller 22 incorporates the elastic layer 22*b* having a thickness not smaller than about 100 micrometers.

A detailed description is now given of a configuration of the heater pair 23.

Both lateral ends of the heater pair 23 in a longitudinal direction thereof parallel to an axial direction of the fixing belt 21 are mounted on side plates of the fixing device 20, respectively. A power supply situated inside the image forming apparatus 1 supplies power to the heater pair 23 so that the heater pair 23 heats the fixing belt 21 to a fixing temperature preset according to the size and the paper weight of the recording medium P, for example. A controller (e.g., a processor), that is, a central processing unit (CPU) provided with a random-access memory (RAM) and a read-only memory (ROM), for example, operatively connected to the heater pair 23 and the temperature sensor 27 controls the heater pair 23 based on the temperature of the outer circumferential surface of the fixing belt 21 detected by the temperature sensor 27 so as to adjust the temperature of the fixing belt 21 to a desired fixing temperature. Alternatively, instead of the heater pair 23, a heater that generates radiation heat such as a halogen heater and a carbon heater may be employed as a heater that heats the fixing belt 21 by radiation heat.

A detailed description is now given of a construction of the nip formation pad 24.

The nip formation pad 24 includes a base pad pressing against an inner circumferential surface of the fixing belt 21 and a slide sheet (e.g., a low-friction sheet) wound around the base pad. A longitudinal direction of the nip formation pad 24 is parallel to the axial direction of the fixing belt 21 or the pressure roller 22. The nip formation pad 24 is mounted on and supported by the stay 25 serving as a support that supports the nip formation pad 24. Accordingly, even if the nip formation pad 24 receives pressure from the pressure roller 22, the nip formation pad 24 is not bent by the pressure and therefore produces a uniform nip width throughout the entire width of the pressure roller 22 in the axial direction thereof. The stay 25 is made of metal having an increased mechanical strength, such as SUS stainless steel and iron, to prevent bending of the nip formation pad 24. Alternatively, the stay 25 may be made of resin.

The base pad of the nip formation pad 24 is made of a heat resistant material resistant against temperatures of 200 degrees centigrade or higher to prevent thermal deformation of the base pad by temperatures in a fixing temperature range desirable to fix the toner image T on the recording medium P, thus retaining the shape of the fixing nip N and quality of the toner image T formed on the recording medium P. For example, the nip formation pad 24 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK).

The base pad of the nip formation pad 24 defines the shape of the fixing nip N formed between the fixing belt 21 and the pressure roller 22 pressed against the base pad via the fixing belt 21 and the slide sheet. Accordingly, an opposed face of the base pad disposed opposite the fixing nip N is substantially planar or straight in cross-section. The base pad is made of a rigid material to retain the substantially planar shape of the opposed face thereof. The opposed face of the base pad is made of crystalline thermoplastic resin used in LCP or the like, for example, an aramid fiber mold. Alternatively, instead of resin, the opposed face of the base pad may be made of a material that facilitates retention of the shape of the opposed face of the base pad, such as metal and ceramic.

A detailed description is now given of a configuration of the reflector 26.

The reflector 26 includes a reflection face 26*c* disposed opposite the heater pair 23 to reflect light radiated from the heater pair 23 thereto toward the fixing belt 21. The reflector 26 is disposed opposite the fixing belt 21 in a circumferential span thereof other than the fixing nip N. The reflection face 26*c* of the reflector 26 is made of aluminum, SUS stainless steel, or the like. The reflector 26 is interposed between the stay 25 and the heater pair 23. According to this exemplary embodiment, the reflector 26 is mounted on the stay 25 that supports the nip formation pad 24. Since the reflector 26 is heated by the heater pair 23 directly, the reflector 26 is made of metal having a high melting point. The reflector 26 reflects light radiated from the heater pair 23 to the stay 25 toward the fixing belt 21, increasing an amount of light that irradiates the fixing belt 21 and thereby heating the fixing belt 21 effectively. Additionally, the reflector 26 suppresses conduction of heat from the heater pair 23 to the stay 25 or the like, saving energy. Alternatively, the reflection face 26*c* of the reflector 26 may be manufactured by treating a surface of the reflector 26 with aluminum-vapor-deposition instead of being made of the material described above.

Figure 5:
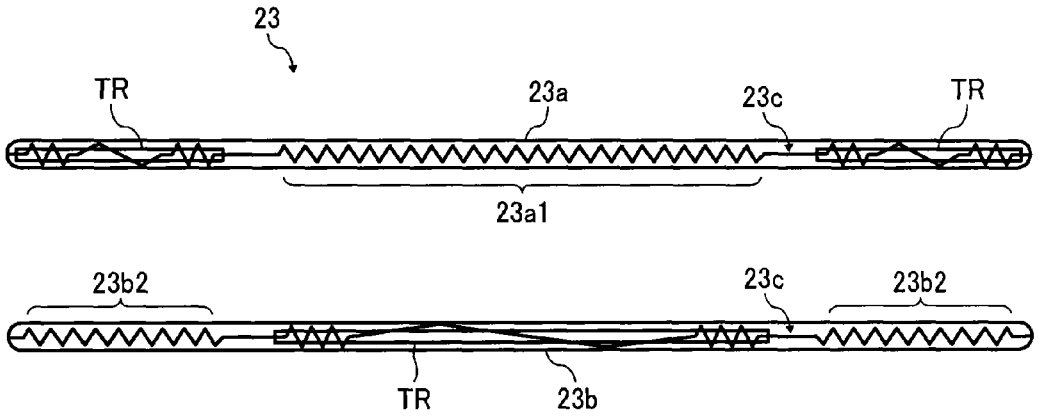
FIG. 5 is a horizontal sectional view of a heater pair incorporated in the fixing device shown in FIG. 4.

With reference to FIG. 5, a description is provided of a construction of the heater pair 23 in detail.

FIG. 5 is a horizontal sectional view of the heater pair 23. As shown in FIG. 5, the heater pair 23 is constructed of a center heater 23*a* serving as a first heater and a lateral end heater 23*b* serving as a second heater provided separately from the center heater 23*a*. The center heater 23*a* and the lateral end heater 23*b* extend in a longitudinal direction thereof that is parallel to the axial direction of the fixing belt 21 perpendicular to the recording medium conveyance direction F1 depicted in FIG. 4.

The center heater 23*a* is a local heater that includes a center heat generator 23*a*1 serving as a first heat generator spanning a first heating span disposed opposite a center of the fixing belt 21 in the axial direction thereof, thus heating the recording medium P conveyed over the center of the fixing belt 21 in the axial direction thereof with radiation heat. The lateral end heater 23*b* is a local heater, separated from the center heater 23*a*, that includes lateral end heat generators 23*b*2 serving as second heat generators disposed opposite both lateral ends of the fixing belt 21 in the axial direction thereof, respectively, thus, together with the center heater 23*a*, heating the recording medium P conveyed over the center and both lateral ends of the fixing belt 21 in the axial direction thereof with radiation heat. Each lateral end heat generator 23*b*2 spans a second heating span disposed opposite each lateral end of the fixing belt 21 in the axial direction thereof. The lateral end heat generators 23*b*2 are connected with each other through coils 23*b*1 constituting a wire rod.

Figure 6:
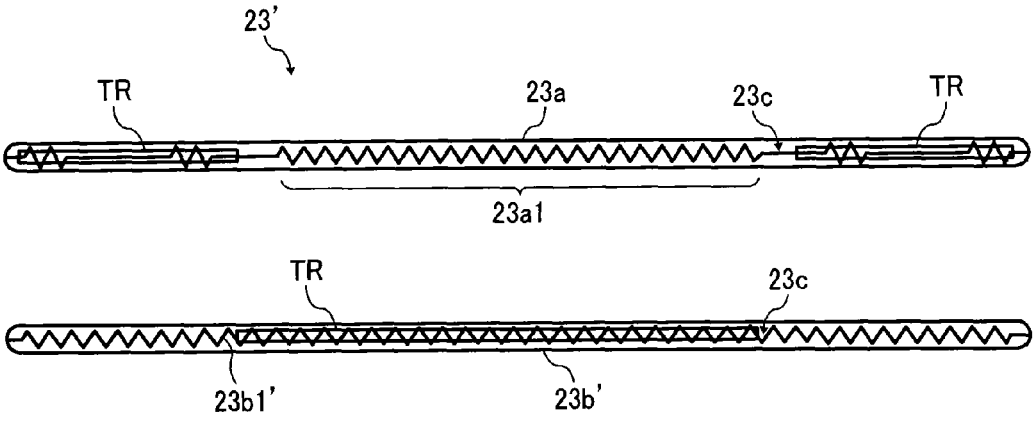
FIG. 6 is a horizontal sectional view of an alternative heater pair installable in the fixing device shown in FIG. 4.

Alternatively, the lateral end heater 23*b* may include an elongated heat generator as shown in FIG. 6 instead of the lateral end heat generators 23*b*2. FIG. 6 is a horizontal sectional view of a heater pair 23' incorporating a lateral end heater 23*b*' serving as a second heater that includes an elongated heat generator 23*b*1' serving as a second heat generator. The elongated heat generator 23*b*1' is a continuous coil extending throughout the entire width of the lateral end heater 23*b*' in a longitudinal direction thereof parallel to the axial direction of the fixing belt 21. That is, the elongated heat generator 23*b*1' spans the entire width of a maximum recording medium P available in the fixing device 20.

The center heater 23*a* and the lateral end heater 23*b* produce light distribution and heating distribution varying in the longitudinal direction thereof to partially generate heat. The center heater 23*a* that heats the center of the fixing belt 21 in the axial direction thereof includes the center heat generator 23*a*1 disposed at a center of the center heater 23*a* in the longitudinal direction thereof. Thus, the center heater 23*a* generates an increased amount of heat at the center thereof relative to both lateral ends thereof. Each of the center heater 23*a*, the lateral end heater 23*b*, and the lateral end heater 23*b*' includes a filament connected with a wire rod serving as an electric circuit 23*c*.

The voltage applied to the heater pair 23 may vary depending on a country or a region where the image forming apparatus 1 is used. Hence, the wire diameter of the filament incorporated in the heater pair 23 may vary. For example, taking commercial power supplies, Japan employs a voltage of 100 V; the United States employs a voltage in a range of from about 110 V to about 120 V; Europe employs a voltage in a range of from 220 V to 240 V. In order to heat the fixing belt 21 to a uniform fixing temperature under the voltage varying depending on the country or the region, the wire diameter of the filament incorporated in the heater pair 23 that may influence the electric current is changed based on a relation with power obtained by multiplying the voltage by the electric current. For example, power that may influence the fixing temperature is determined according to an energization time by defining a time to turn on and off the heater pair 23 under duty control.

The wire diameter of the filament is changed according to the voltage range available in the country or the region where the image forming apparatus 1 is used. For example, for the voltage range of from 220 V to 240 V, the heater pair 23 employs the filament having a wire diameter substantially half of a wire diameter of the filament incorporated in the heater pair 23 for the voltage of 100 V. If the heater pair 23 employs heater wires having different wire diameters, respectively, problems may occur as below. For example, the heater pair 23 includes the center heater 23*a* configured to heat the center of the fixing belt 21 in the axial direction thereof and the lateral end heater 23*b* configured to heat both lateral ends of the fixing belt 21 in the axial direction thereof. The lateral end heater 23*b* is requested to reduce heat generation at a center in the longitudinal direction thereof. To address this request, the lateral end heater 23*b* may include a heat generation restrainer provided in a heater wire extending through the center of the lateral end heater 23*b* in the longitudinal direction thereof to connect one lateral end heat generator 23*b*2 to another lateral end heat generator 23*b*2. Accordingly, the heater wire is requested to have a mechanical strength great enough to mount the heat generation restrainer.

If the heater wire is thick, the heater wire has a mechanical strength great enough to support the heat generation restrainer. Conversely, if the heater wire is thin, the heater wire may not have a mechanical strength great enough to support the heat generation restrainer. Hence, the lateral end heater 23*b* may generate heat at the center in the longitudinal direction thereof that should not generate heat, overheating peripheral components.

Since the filament of the center heater 23*a* is electrically connected to the filament of the lateral end heater 23*b* through a connection portion, the connection portion may generate heat and thereby overheat at each lateral end span of the heater pair 23 disposed opposite a non-conveyance span of the fixing belt 21 where the recording medium P is not conveyed. Accordingly, the heater pair 23 may increase the temperature of the reflection face 26*c* of the reflector 26 depicted in FIG. 4, resulting in tarnishing of the reflection face 26*c* of the reflector 26 due to thermal oxidation of a material treated with deposition on the reflection face 26*c*. The tarnished reflection face 26*c* may degrade its reflection performance to reflect light radiated from the heater pair 23 thereto toward the fixing belt 21, heating the fixing belt 21 slowly and thereby lengthening a first print time taken to output the recording medium P bearing the fixed toner image T onto the output tray 17 depicted in FIG. 3 upon receipt of a print job in a standby mode in which the fixing device 20 waits for the print job. Additionally, as the temperature of the reflector 26 increases, the reflector 26 may heat the stay 25 mounting the reflector 26, adversely affecting peripheral components supported by the stay 25 by heat.

To address this circumstance, the heater pair 23 may have a configuration described below. The heater pair 23 installed in the fixing device 20 shown in FIG. 4 is operable at a voltage of 100 V used for commercial power supplies available in Japan, for example, among voltages in a range of from 100 V to 240 V. Accordingly, the heater pair 23 has an increased wire diameter relative to a heater operable at a voltage higher than 100 V to attain a predetermined amount of heat.

As shown in FIG. 5, the center heater 23*a* has fewer coils at both lateral ends in the longitudinal direction thereof the lateral end heater 23*b* has fewer coils at the center in the longitudinal direction thereof. Accordingly, the center heater 23*a* generates a decreased amount of heat at both lateral ends in the longitudinal direction thereof; the lateral end heater 23*b* generates a decreased amount of heat at the center in the longitudinal direction thereof. If each of the center heater 23*a* and the lateral end heater 23*b* has an increased heater wire diameter, the heater pair 23 has an increased mechanical strength. Hence, the center heater 23*a* includes a tungsten rod TR serving as a heat generation restrainer provided in the electric circuit 23*c* connected with the center heat generator 23*a*1. The tungsten rod TR is disposed at a portion of the center heater 23*a* where heat generation is not necessary. The tungsten rod TR is supported by the wire rod to restrict heat generation at each lateral end of the center heater 23*a* in the longitudinal direction thereof that is disposed opposite the non-conveyance span of the fixing belt 21 where the recording medium P is not conveyed, thus preventing waste of heat. The tungsten rod TR, if it is installed in the center heater 23*a*, is provided in the electric circuit 23*c* disposed at each lateral end of the center heater 23*a* that is outboard from the center heat generator 23*a*1 in the longitudinal direction of the center heater 23*a*. Conversely, the tungsten rod TR, if it is installed in the lateral end heater 23*b*, is provided in the electric circuit 23*c* disposed at the center of the lateral end heater 23*b* interposed between the lateral end heat generators 23*b*2 in the longitudinal direction of the lateral end heater 23*b*.

As shown in FIG. 6, the tungsten rod TR may also be applicable to the lateral end heater 23*b*' serving as a second heater incorporating the elongated heat generator 23*b*1', that is, the continuous coil extending throughout the entire width of the lateral end heater 23*b*' in the longitudinal direction thereof. For example, the tungsten rod TR is provided at a center of the lateral end heater 23*b*' in the longitudinal direction thereof.

Figure 7:
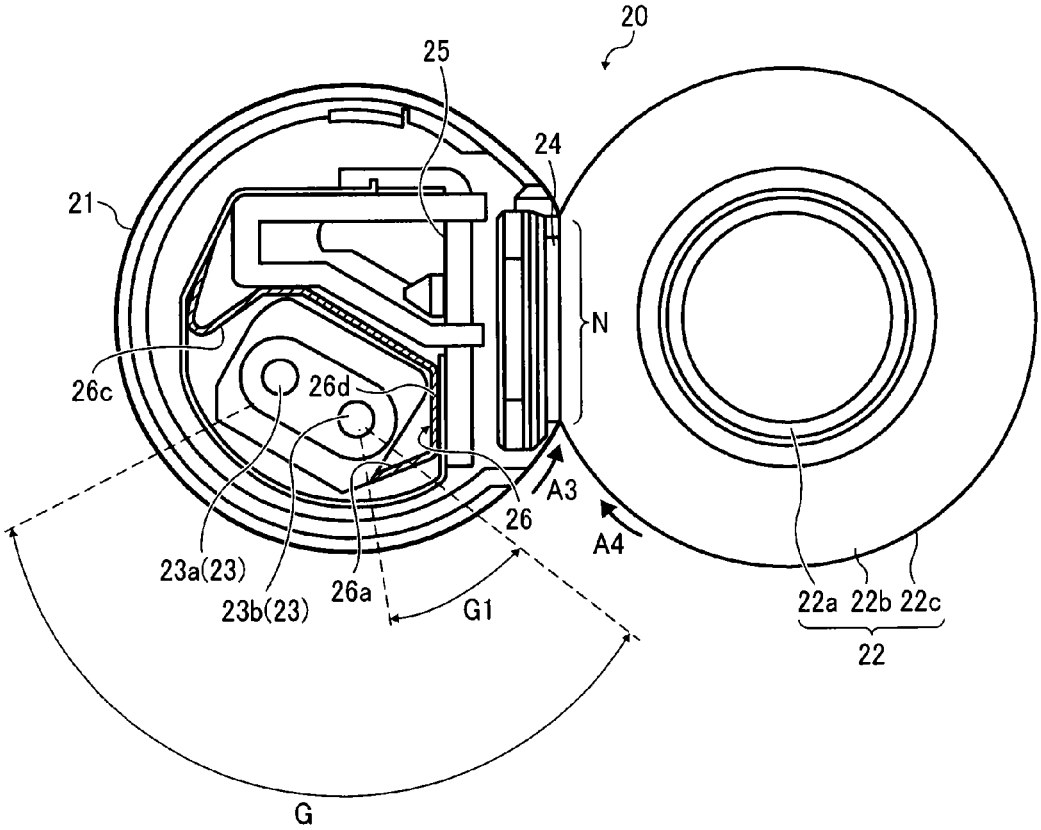
FIG. 7 is a vertical sectional view of the fixing device shown in FIG. 4 illustrating a reflector incorporated therein.
Figure 8:
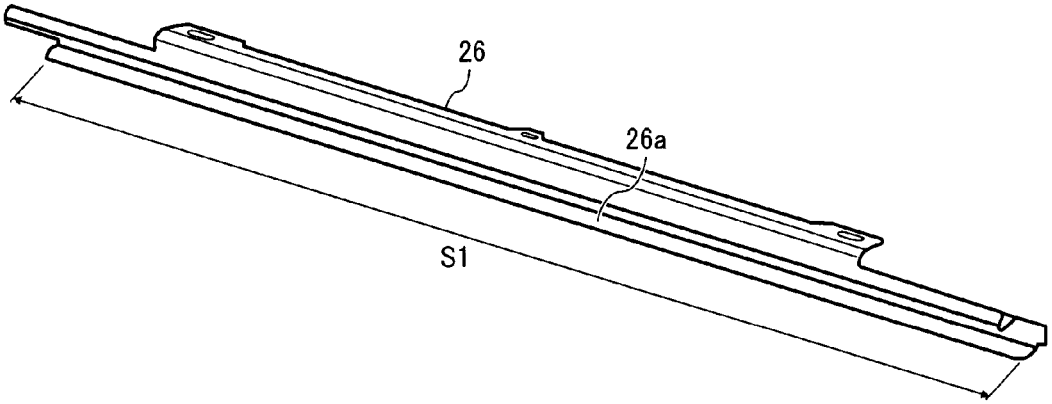
FIG. 8 is a perspective view of the reflector shown in FIG. 7.

With reference to FIGS. 7 and 8, a description is provided of a configuration of the reflector 26 to shield the fixing belt 21 from the heater pair 23.

FIG. 7 is a vertical sectional view of the fixing device 20. FIG. 8 is a perspective view of the reflector 26. As shown in FIG. 7, the reflector 26 further includes a shield portion 26*a* interposed between the heater pair 23 and the fixing belt 21 to shield the fixing belt 21 from the heater pair 23. As shown in FIG. 8, the shield portion 26*a* is disposed at a center of the reflector 26 in a longitudinal direction thereof. A length of the shield portion 26*a* in the longitudinal direction of the reflector 26 is at least equivalent to or greater than a width of a small recording medium P. As shown in FIG. 7, the heater pair 23 irradiates the fixing belt 21 in a circumferential irradiation span G. The shield portion 26*a* of the reflector 26 shields the fixing belt 21 from the heater pair 23 in a circumferential shield span G1. The shield portion 26*a* shields the fixing belt 21 from the heater pair 23 when a movable light shield described below does not shield the fixing belt 21 from the heater pair 23 at a predetermined position as the fixing device 20 is downsized.

As shown in FIG. 7, the reflector 26 is mounted on the stay 25. As shown in FIGS. 7 and 8, a part of the reflector 26 is bent to project from an abutment portion 26*d* serving as a body of the reflector 26 abutting the stay 25 so as to produce the shield portion 26*a* disposed in proximity to the heater pair 23.

As an A3 size recording medium is conveyed over the fixing belt 21, the center heater 23*a* and the lateral end heater 23*b* depicted in FIG. 5 are turned on to generate heat. The tungsten rod TR is provided in the wire rod of the center heater 23*a* at positions outboard from the center heat generator 23*a*1 in the longitudinal direction of the center heater 23*a*; the tungsten rod TR is provided in the wire rod of the lateral end heater 23*b* at a position inboard from the lateral end heat generator 23*b*2 in the longitudinal direction of the lateral end heater 23*b*. Thus, the tungsten rod TR suppresses heat generation at each lateral end of the center heater 23*a* that is outboard from the center heat generator 23*a*1 in the longitudinal direction of the center heater 23*a* and at the center of the lateral end heater 23*b* that is inboard from the lateral end heat generator 23*b*2 in the longitudinal direction of the lateral end heater 23*b*.

Accordingly, temperature increase is suppressed at sections of the center heater 23*a* and the lateral end heater 23*b* other than the center heat generator 23*a*1 and the lateral end heat generators 23*b*2, where the tungsten rod TR is situated. Consequently, the shield portion 26*a* of the reflector 26 does not overheat at sections of the shield portion 26*a* that are disposed opposite the sections of the center heater 23*a* and the lateral end heater 23*b* other than the center heat generator 23*a*1 and the lateral end heat generators 23*b*2.

Conversely, as a postcard size recording medium, that is, a minimum recording medium available in the fixing device 20, is conveyed over the fixing belt 21, the shield portion 26*a* of the reflector 26 shields the fixing belt 21 from the heater pair 23 and at the same time the center heater 23*a* is turned on while the lateral end heater 23*b* is turned off. Since the tungsten rod TR is provided at each lateral end of the center heater 23*a* in the longitudinal direction thereof, the center heater 23*a* generates heat at the center heat generator 23*a*1. Accordingly, as a recording medium P having an increased thickness such as a postcard is conveyed over the fixing belt 21, even if the fixing belt 21 heats the postcard under a temperature lower than a temperature at which the fixing belt 21 heats the A3 size recording medium for an increased fixing time, the heater pair 23 heats the fixing belt 21 at a restricted span thereof where the postcard is conveyed, thus improving heating efficiency. Consequently, overheating of the shield portion 26*a* of the reflector 26 that may result in oxidation of the reflection face 26*c* of the reflector 26 depicted in FIG. 4 is suppressed, preventing decrease in the reflection rate of the reflector 26. Prevention of decrease in the reflection rate of the reflector 26 and efficient conduction of heat from the center heat generator 23*a*1 to a conveyance span of the fixing belt 21 where the postcard is conveyed retain the reflection efficiency of the reflector 26 to reflect light toward the fixing belt 21 and shorten the first print time taken from receipt of a print job in the standby mode until the image forming apparatus 1 depicted in FIG. 3 outputs the recording medium P bearing the fixed toner image T.

The fixing device 20 may further include a light shield 100 in addition to the shield portion 26*a* of the reflector 26 described above. The light shield 100, in combination with the reflector 26, changes a heating span of the fixing belt 21 where the heater pair 23 heats the fixing belt 21 according to the size of the recording medium P conveyed over the fixing belt 21.

Figure 9:
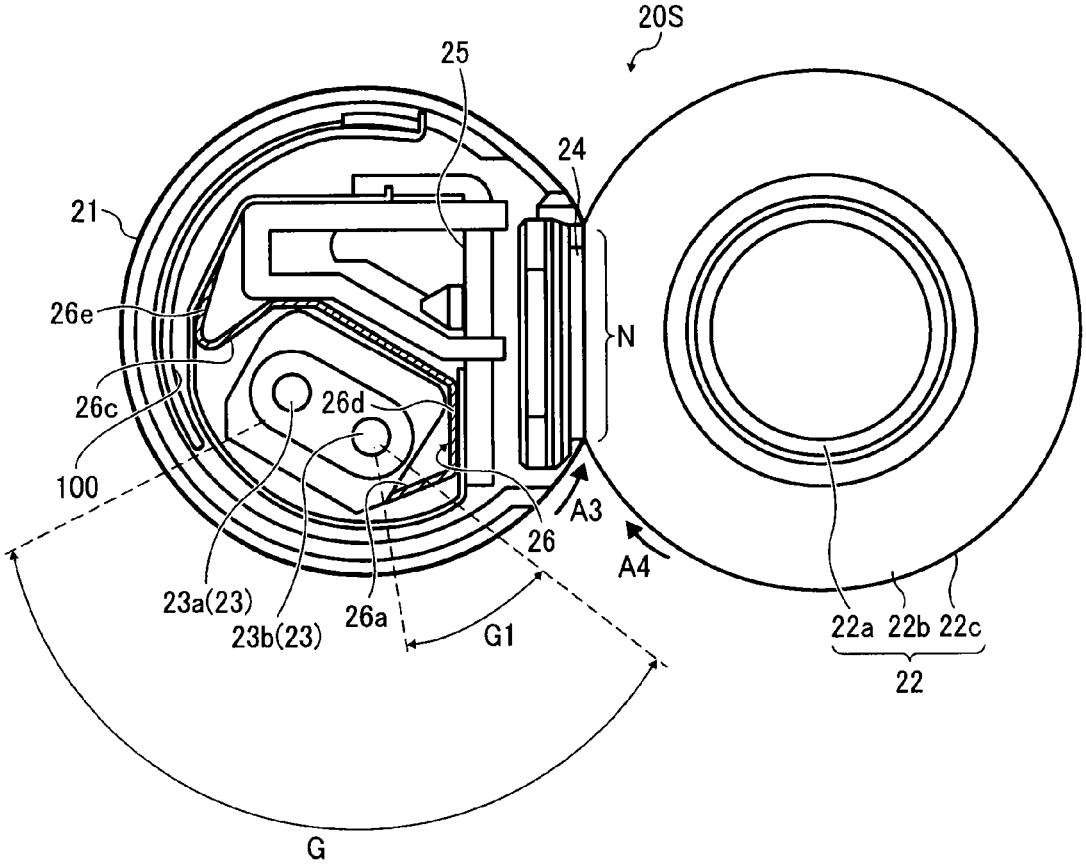
FIG. 9 is a vertical sectional view of a fixing device according to another exemplary embodiment.

With reference to FIG. 9, a description is provided of a construction of a fixing device 20S incorporating the light shield 100.

FIG. 9 is a vertical sectional view of the fixing device 20S. As shown in FIG. 9, the light shield 100 is movable in a circumferential direction of the fixing belt 21 to shield the fixing belt 21 from the heater pair 23 in a variable axial shield span of the fixing belt 21 in the axial direction perpendicular to the rotation direction A3 thereof where the recording medium P is not conveyed over the fixing belt 21. The light shield 100 is partially disposed opposite the heater pair 23 via the stay 25. The light shield 100 is disposed opposite a reversed portion 26*e* of the reflector 26 that is disposed in proximity to the heater pair 23.

Figure 10:
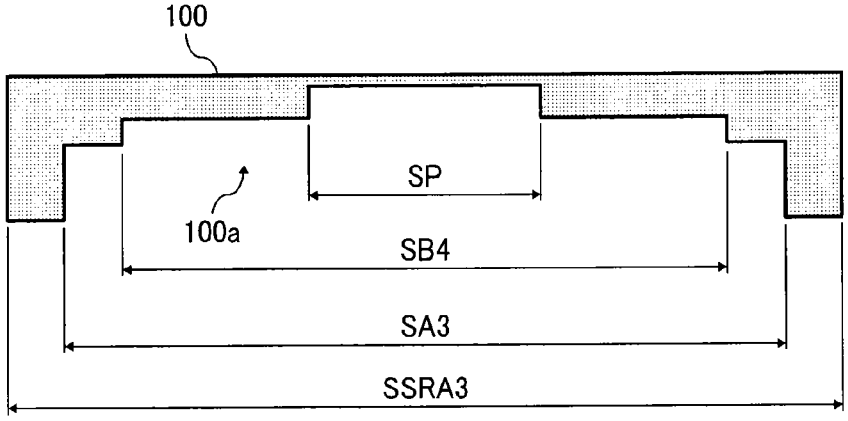
FIG. 10 is a development of a light shield incorporated in the fixing device shown in FIG. 9.

The light shield 100 has a shape that produces a shield area corresponding to the size of the recording medium P in the axial direction of the fixing belt 21. FIG. 10 is a development of the light shield 100. As shown in FIG. 10, the light shield 100 is contoured to create a recess 100*a* that produces a plurality of axial heating spans that allows the heater pair 23 to irradiate the fixing belt 21 stepwise according to a plurality of sizes of the recording media P conveyed over the fixing belt 21. The recess 100*a* produces the plurality of axial heating spans corresponding to the width of recording media of various sizes frequently used in Japan: an axial heating span SP corresponding to the width of a postcard; an axial heating span SB4 corresponding to the width of a B4 size recording medium; an axial heating span SA3 corresponding to the width of an A3 size recording medium; and an axial heating span SSRA3 corresponding to the width of an SRA3 size recording medium. The width of the SRA3 size recording medium, that is, the maximum recording medium available in the fixing device 20S, is greater than the axial width of the recess 100*a*.

With reference to FIGS. 11A to 11D, a description is provided of movement of the light shield 100.

Figure 11A:
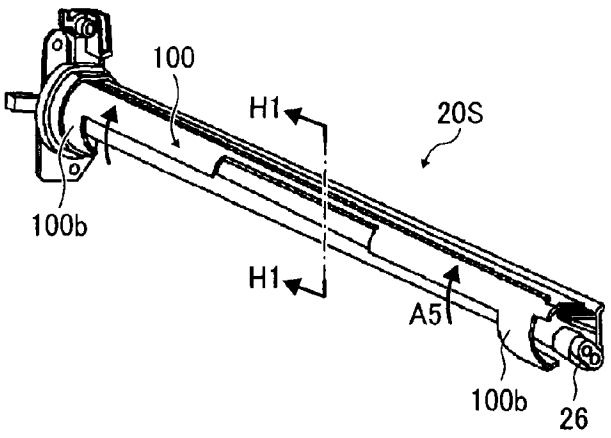
FIG. 11A is a partial perspective view of the fixing device shown in FIG. 9 illustrating the light shield at a decreased shield position.
Figure 11B:
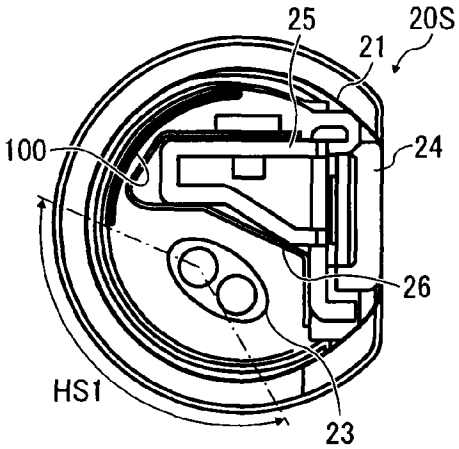
FIG. 11B is a vertical sectional view of the fixing device shown in FIG. 11A taken on line H1-H1 of FIG. 11A.
Figure 11C:
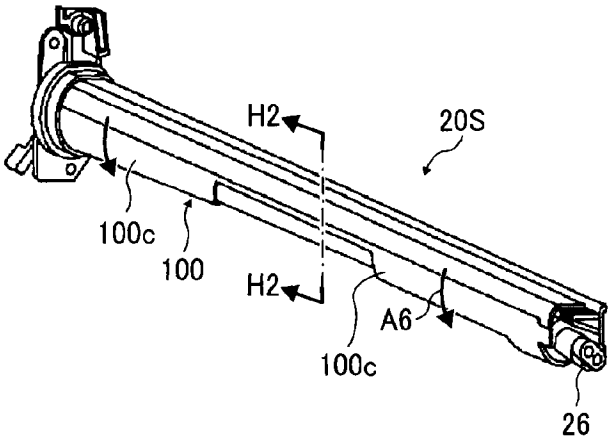
FIG. 11C is a partial perspective view of the fixing device shown in FIG. 9 illustrating the light shield at an increased shield position.
Figure 11D:
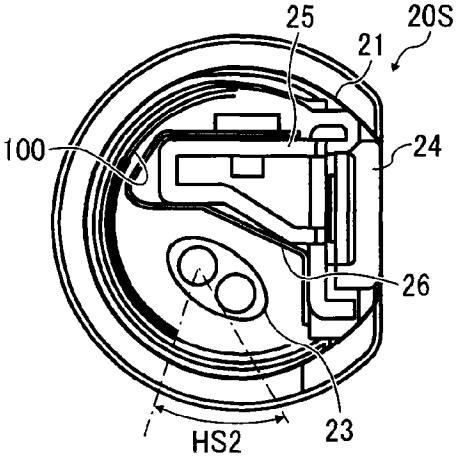
FIG. 11D is a vertical sectional view of the fixing device shown in FIG. 11C taken on line H2-H2 of FIG. 11C.

FIG. 11A is a partial perspective view of the fixing device 20S illustrating the light shield 100 at a decreased shield position. FIG. 11B is a vertical sectional view of the fixing device 20S taken on line H1-H1 of FIG. 11A. FIG. 11C is a partial perspective view of the fixing device 20S illustrating the light shield 100 at an increased shield position. FIG. 11D is a vertical sectional view of the fixing device 20S taken on line H2-H2 of FIG. 11C.

When the A3 size recording medium or the SRA3 size recording medium is conveyed through the fixing device 20S, the light shield 100 moves in a rotation direction A5 in the circumferential direction of the fixing belt 21 to the decreased shield position shown in FIG. 11A to allow the heater pair 23 to irradiate the fixing belt 21 in an increased axial heating span of the fixing belt 21. Conversely, when the A3 size recording medium or the recording medium smaller than the A3 size recording medium including the postcard is conveyed through the fixing device 20S, the light shield 100 moves in a rotation direction A6 in the circumferential direction of the fixing belt 21 to the increased shield position shown in FIG. 11C to allow the heater pair 23 to irradiate the fixing belt 21 in a decreased axial heating span of the fixing belt 21.

When the light shield 100 is at the decreased shield position shown in FIG. 11A, an outboard shield portion 100*b* disposed at each lateral end of the light shield 100 in a longitudinal direction thereof parallel to the axial direction of the fixing belt 21 is disposed opposite the heater pair 23 to allow the heater pair 23 to heat the fixing belt 21 in the increased axial heating span thereof. Accordingly, the light shield 100 at the decreased shield position produces an increased circumferential heating span HS 1 where the heater pair 23 heats the fixing belt 21 as shown in FIG. 11B.

When the light shield 100 is at the increased shield position shown in FIG. 11C, an inboard shield portion 100*c* disposed inboard from each outboard shield portion 100*b* in the longitudinal direction of the light shield 100 is disposed opposite the heater pair 23 to allow the heater pair 23 to heat the fixing belt 21 in the decreased axial heating span thereof. Accordingly, the light shield 100 at the increased shield position produces a decreased circumferential heating span HS2 where the heater pair 23 heats the fixing belt 21 as shown in FIG. 11D. Hence, the light shield 100 movable in the circumferential direction of the fixing belt 21 to change the axial heating span produced by the recess 100*a* depicted in FIG. 10 changes an irradiation area of the fixing belt 21 where light reflected by the reflector 26 irradiates the fixing belt 21.

On the other hand, even if the movable light shield 100 that shields the non-conveyance span of the fixing belt 21 from the heater pair 23 is employed, the light shield 100 may not move to a position disposed opposite the non-conveyance span of the fixing belt 21 if the fixing device 20S is downsized. Accordingly, the peripheral components not shielded by the light shield 100 may overheat.

To address this circumstance, it may be necessary to install another light shield to shield the fixing belt 21 from the heater pair 23 at a position where the light shield 100 does not reach. For example, combination of the light shield 100 and the reflector 26 that reflects light radiated from the heater pair 23 thereto toward the fixing belt 21 may be employed. The reflector 26 includes the shield portion 26*a* that shields the fixing belt 21 from the heater pair 23 at the position where the light shield 100 does not reach.

As shown in FIG. 9, since the abutment portion 26*d* serving as a body of the reflector 26 is mounted on the stay 25 disposed inside the fixing belt 21, the shield portion 26*a* of the reflector 26 projects from the abutment portion 26*d* toward the position where the light shield 100 does not reach. Unlike the abutment portion 26*d* of the reflector 26 mounted on the stay 25, the shield portion 26*a* of the reflector 26 does not contact the stay 25 directly. Accordingly, if movement of the light shield 100 is restricted to produce a gap (e.g., an aperture) between the light shield 100 and the abutment portion 26*d* of the reflector 26, the heater pair 23 may irradiate the shield portion 26*a* of the reflector 26 through the gap, increasing the temperature of the shield portion 26*a* of the reflector 26. Consequently, heat is conducted from the shield portion 26*a* to the entire reflector 26 which in turn heats the stay 25. As the entire reflector 26 is heated, the reflection face 26*c* of the reflector 26 is also heated, resulting in tarnishing of the reflection face 26*c* of the reflector 26.

As the heater pair 23 includes the plurality of heaters, that is, the center heater 23*a* and the lateral end heater 23*b* having the center heat generator 23*a*1 and the lateral end heat generators 23*b*2 that heat different axial heating spans of the fixing belt 21 in the axial direction thereof according to the size of the recording medium P, respectively, since filaments of the center heater 23*a* and the lateral end heater 23*b* are electrically connected to each other through the connection portion, the connection portion may generate heat and thereby overheat at each lateral end span of the heater pair 23 disposed opposite the non-conveyance span of the fixing belt 21 where the recording medium P is not conveyed. As the heater pair 23 overheats at each lateral end in the longitudinal direction thereof, the heater pair 23 heats the shield portion 26*a* of the reflector 26 which in turn heats the reflection face 26*c* of the reflector 26, resulting in tarnishing of the reflection face 26*c* of the reflector 26.

The tarnished reflection face 26*c* of the reflector 26 may decrease its reflection efficiency, degrading heating efficiency to heat the fixing belt 21 and lengthening the first print time upon receipt of a print job in the standby mode. Additionally, the heated reflector 26 may heat the stay 25 supporting the reflector 26 and other peripheral components, adversely affecting the stay 25 and the peripheral components by heat. The heated stay 25 may degrade its supporting performance. For example, the stay 25 may not position the reflector 26 with respect to the heater pair 23 precisely and may not support the nip formation pad 24.

Figure 12:
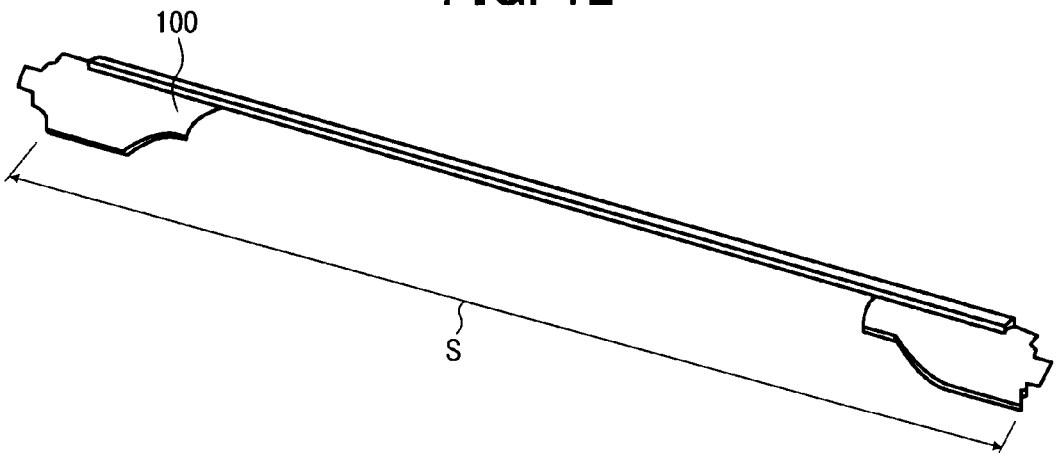
FIG. 12 is a perspective view of the light shield incorporated in the fixing device shown in FIG. 9.

With reference to FIG. 12, a description is provided of an example of combination of the light shield 100 described above and the reflector 26 shown in FIGS. 7 and 8.

FIG. 12 is a perspective view of the light shield 100. The reflector 26 and the light shield 100 have a relation below. An axial span Si of the shield portion 26*a* of the reflector 26 shown in FIG. 8 is not smaller than an axial span S of the light shield 100 shown in FIG. 12. Like the reflector 26 shown in FIG. 7, the reflector 26 of the fixing device 20S is mounted on and supported by the stay 25 as shown in FIG. 9. A part of the reflector 26 is bent to project from the abutment portion 26*d* abutting the stay 25 so as to produce the shield portion 26*a* disposed in proximity to the heater pair 23. As shown in FIG. 9, the heater pair 23 irradiates the fixing belt 21 in the circumferential irradiation span G. The shield portion 26*a* of the reflector 26 shields the fixing belt 21 from the heater pair 23 in the circumferential shield span G1. The shield portion 26*a* shields the fixing belt 21 from the heater pair 23 when a leading edge of the light shield 100 does not shield the fixing belt 21 from the heater pair 23 at a predetermined position as the fixing device 20S is downsized and restricts movement of the light shield 100.

Movement of the light shield 100 is restricted as below. When a postcard or a recording medium equivalent to or smaller than the A3 size recording medium is conveyed through the fixing device 20S, the light shield 100 moves in the rotation direction A6 in an increased amount of movement as shown in FIGS. 11C and 11D. When the leading edge of the light shield 100 in the rotation direction A6 does not reach a predetermined angled position, the light shield 100 may produce an aperture through which the heater pair 23 irradiates the fixing belt 21. To address this circumstance, the shield portion 26*a* of the reflector 26 shields the fixing belt 21 from the heater pair 23 at the predetermined angled position on the fixing belt 21, thus preventing light from the heater pair 23 from irradiating the fixing belt 21 through the aperture. The leading edge of the light shield 100 may not reach the predetermined angled position when peripheral components interfere with movement of the light shield 100 in a movement path as the peripheral components are packed in the downsized fixing device 20S. The shield portion 26*a* of the reflector 26 depicted in FIG. 8 overlaps the aperture produced between the leading edge of the light shield 100 and the reflector 26 to block light traveling through the aperture. Accordingly, the shield portion 26*a* of the reflector 26 prevents overheating of the fixing belt 21 at each lateral end in the axial direction thereof, thereby suppressing or preventing variation in temperature of the fixing belt 21 in the axial direction thereof.

The light shield 100, situated in proximity to and disposed opposite the center heater 23*a* and the lateral end heater 23*b*, is movable to the decreased shield position shown in FIGS. 11A and 11B and the increased shield position shown in FIGS. 11C and 11D to shield the fixing belt 21 from the center heater 23*a* and the lateral end heater 23*b* in the non-conveyance span of the fixing belt 21 where the recording medium P is not conveyed. As shown in FIG. 9, the shield portion 26*a* of the reflector 26 projects from the abutment portion 26*d* of the reflector 26 toward the light shield 100.

Figure 13:
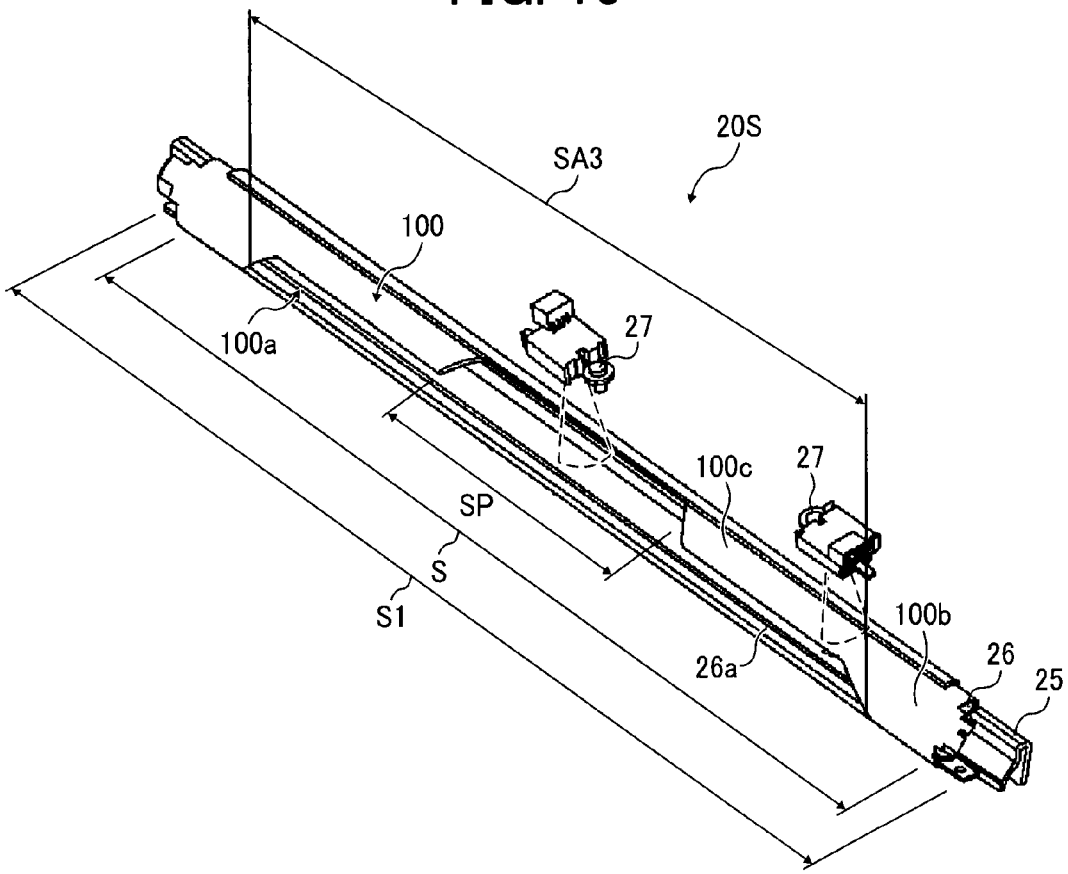
FIG. 13 is a partial perspective view of the fixing device shown in FIG. 9.

FIG. 13 is a partial perspective view of the fixing device 20S. As shown in FIG. 13, the shield portion 26*a* of the reflector 26 is disposed opposite at least a lateral end span of the light shield 100 in the longitudinal direction thereof other than a center span of the light shield 100 in the longitudinal direction thereof. For example, the shield portion 26*a* of the reflector 26 is disposed opposite at least the outboard shield portion 100*b* and the inboard shield portion 100*c* of the light shield 100. Accordingly, even when the leading edge of the light shield 100 in the rotation direction A6 does not reach the predetermined angled position and therefore produces the aperture through which the heater pair 23 irradiates the fixing belt 21, the shield portion 26*a* of the reflector 26 overlaps the aperture to block light from the heater pair 23. Thus, the shield portion 26*a* of the reflector 26 prevents leakage of light to the fixing belt 21 through the aperture. Consequently, even if the leading edge of the light shield 100 does not reach the predetermined angled position when the peripheral components interfere with movement of the light shield 100 in the movement path as the peripheral components are packed in the downsized fixing device 20S, the shield portion 26*a* of the reflector 26 shields the fixing belt 21 from the heater pair 23 on behalf of the light shield 100.

With reference to FIG. 13, a description is provided of an operation of the fixing device 20S incorporating the light shield 100 and the reflector 26 described above.

FIG. 13 illustrates the light shield 100 at the decreased shield position where the light shield 100 shields the fixing belt 21 from the heater pair 23 when an A3 size recording medium is conveyed through the fixing device 20S. The light shield 100 is disposed opposite the heater pair 23 such that the recess 100*a* having the axial heating span SA3 is disposed opposite the heater pair 23. The center heater 23*a* and the lateral end heater 23*b* of the heater pair 23 are turned on to start heating the fixing belt 21.

As shown in FIG. 5, the tungsten rod TR is provided in the wire rod of the center heater 23*a* and the lateral end heater 23*b* at the positions other than the center heat generator 23*a*1 and the lateral end heat generators 23*b*2, respectively. Thus, the tungsten rod TR suppresses heat generation at the positions thereof. Accordingly, temperature increase is suppressed at sections of the center heater 23*a* and the lateral end heater 23*b* other than the center heat generator 23*a*1 and the lateral end heat generators 23*b*2, where the tungsten rod TR is situated. Consequently, the shield portion 26*a* of the reflector 26 does not overheat at sections thereof that are disposed opposite the sections of the center heater 23*a* and the lateral end heater 23*b* other than the center heat generator 23*a*1 and the lateral end heat generators 23*b*2.

Conversely, as a postcard size recording medium, that is, the minimum recording medium available in the fixing device 20S, is conveyed over the fixing belt 21, the light shield 100 shields the fixing belt 21 from the heater pair 23 and at the same time the center heater 23*a* is turned on while the lateral end heater 23*b* is turned off. Since the tungsten rod TR is provided at each lateral end of the center heater 23*a* in the longitudinal direction thereof, the center heater 23*a* generates heat at the center heat generator 23*a*1. Accordingly, as a recording medium P having an increased thickness such as a postcard is conveyed over the fixing belt 21, even if the fixing belt 21 heats the postcard under a temperature lower than a temperature at which the fixing belt 21 heats an A4 size recording medium for an increased fixing time, the heater pair 23 heats the fixing belt 21 at a restricted span thereof where the postcard is conveyed, thus improving heating efficiency. Consequently, overheating of the shield portion 26*a* of the reflector 26 that may result in oxidation of the reflection face 26*c* of the reflector 26 is suppressed, preventing decrease in the reflection rate of the reflector 26.

Prevention of decrease in the reflection rate of the reflector 26 and efficient conduction of heat from the center heat generator 23*a*1 to a conveyance span of the fixing belt 21 where the postcard is conveyed retain the reflection efficiency of the reflector 26 to reflect light radiated from the heater pair 23 thereto toward the fixing belt 21 and shorten the first print time taken from receipt of a print job in the standby mode until the image forming apparatus 1 depicted in FIG. 3 outputs the recording medium P bearing the fixed toner image T. The tungsten rod TR provided in the heater pair 23 prevents overheating of the shield portion 26*a* of the reflector 26 configured to supplement shielding of the light shield 100. Consequently, overheating of the shield portion 26*a* of the reflector 26 that may result in oxidation of the reflection face 26*c* of the reflector 26 is suppressed, thus preventing tarnishing of the reflector 26.

The present invention is not limited to the details of the exemplary embodiments described above, and various modifications and improvements are possible. For example, instead of the heater pair 23 constructed of two heaters, that is, the center heater 23*a* and the lateral end heater 23*b* or 23*b*', the fixing devices 20 and 20S depicted in FIGS. 7 and 9, respectively, may incorporate three or more heaters.

With reference to FIGS. 7 and 9, a description is provided of advantages of the fixing devices 20 and 20S.

The fixing devices 20 and 20S include the endless fixing belt 21 serving as a fixing rotator rotatable in the rotation direction A3; the nip formation pad 24 disposed inside the fixing belt 21; the stay 25 serving as a support disposed inside the fixing belt 21 to support the nip formation pad 24; the pressure roller 22 serving as an opposed rotator pressed against the nip formation pad 24 via the fixing belt 21 to form the fixing nip N between the pressure roller 22 and the fixing belt 21; the heater pair 23 serving as a heater disposed opposite the fixing belt 21 at a position other than the fixing nip N to heat the fixing belt 21 directly; and the reflector 26 interposed between the heater pair 23 and the stay 25 and extending in a direction perpendicular to the rotation direction A3 of the fixing belt 21 to reflect light radiated from a back face of the heater pair 23 disposed opposite the reflector 26 toward the fixing belt 21. As a recording medium P bearing a toner image T is conveyed through the fixing nip N, the fixing belt 21 and the pressure roller 22 fix the toner image T on the recording medium P under heat and pressure.

As shown in FIG. 5, the heater pair 23 includes the center heater 23*a* serving as a first heater having the center heat generator 23*a*1 serving as a first heat generator disposed opposite the center of the fixing belt 21 in the axial direction thereof to heat the center of the fixing belt 21 with radiation heat and the lateral end heater 23*b* serving as a second heater having the lateral end heat generator 23*b*2 serving as a second heat generator disposed opposite each lateral end of the fixing belt 21 in the axial direction thereof to heat each lateral end of the fixing belt 21 with radiation heat. Each of the center heater 23*a* and the lateral end heater 23*b* includes the electric circuit 23*c* connected to the center heat generator 23*a*1 and the lateral end heat generator 23*b*2, respectively. The electric circuit 23*c* is provided with the tungsten rod TR serving as a heat generation restrainer to restrict heat generation in the electric circuit 23*c*. As shown in FIGS. 7 and 9, the reflector 26 is mounted on and supported by the stay 25. The reflector 26 includes the abutment portion 26*d* serving as a body of the reflector 26 that is mounted on and supported by the stay 25 and the shield portion 26*a* projecting from the abutment portion 26*d* toward the heater pair 23 to shield the fixing belt 21 from the heater pair 23.

Accordingly, the tungsten rod TR reduces unnecessary heat generation of the heater pair 23 and the shield portion 26*a* of the reflector 26 reduces leakage of heat to the fixing belt 21 when movement of the light shield 100 is restricted, thus suppressing or preventing overheating of the reflector 26.

The fixing devices 20 and 20S and the image forming apparatus 1 incorporating the fixing device 20 or 20S, even if the fixing devices 20 and 20S are downsized, overcome problems that may occur as the first print time is shortened. The problems include thermal degradation of the peripheral components caused by heat conducted from the overheated reflector 26 through the stay 25 and degradation of reflection efficiency of the reflector 26 caused by tarnishing of the reflection face 26*c* of the reflector 26.

As shown in FIGS. 11A and 11C, the light shield 100 has the outboard shield portion 100*b* and the inboard shield portion 100*c* disposed at each lateral end of the light shield 100 in the longitudinal direction thereof. Alternatively, the outboard shield portion 100*b* and the inboard shield portion 100*c* may be disposed at one lateral end of the light shield 100 in the longitudinal direction thereof. In this case, the recording medium P is conveyed over the fixing belt 21 along one lateral edge of the fixing belt 21 in the axial direction thereof and the outboard shield portion 100*b* and the inboard shield portion 100*c* are disposed in proximity to another lateral edge of the fixing belt 21 in the axial direction thereof.

According to the exemplary embodiments described above, the fixing belt 21 serves as a fixing rotator. Alternatively, a fixing film, a fixing roller, or the like may be used as a fixing rotator. Further, the pressure roller 22 serves as an opposed rotator. Alternatively, a pressure belt or the like may be used as an opposed rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

a first heat generator disposed opposite the fixing rotator to heat the fixing rotator and spanning a first heating span in an axial direction of the fixing rotator;

a second heat generator disposed opposite the fixing rotator to heat the fixing rotator and spanning a second heating span in the axial direction of the fixing rotator that is different from the first heating span;

a support disposed inside the fixing rotator;

an opposed rotator contacting the fixing rotator to form a fixing nip therebetween, through which a recording medium bearing a toner image is conveyed; and an electric circuit disposed in at least one of the first heat generator and the second heat generator, the electric circuit including:

a filament; and a heat generation restrainer connected to the filament, the heat generation restrainer includes a tungsten rod, and the filament is coiled around the tungsten rod across an entire length of the tungsten rod in the axial direction.

2. The fixing device according to claim 1, wherein the second heat generator is disposed opposite a lateral end of the fixing rotator in the axial direction thereof.

3. The fixing device according to claim 1, wherein the second heat generator is disposed opposite a substantially entire span of the fixing rotator in the axial direction thereof.

4. The fixing device according to claim 1, wherein the first heat generator is disposed opposite a center of the fixing rotator in the axial direction thereof and the second heat generator is disposed opposite each lateral end of the fixing rotator in the axial direction thereof.

5. The fixing device according to claim 4, wherein the heat generation restrainer is disposed outboard from the first heat generator in the axial direction of the fixing rotator and disposed between the second heat generators in the axial direction of the fixing rotator.

6. The fixing device according to claim 1, further comprising a reflector that includes a reflection face treated with vapor deposition.

7. The fixing device according to claim 1, wherein power supply to the first heat generator and the second heat generator is controlled according to a size and a paper weight of the recording medium.

8. The fixing device according to claim 1, further comprising a light shield interposed between the fixing rotator and each of the first heat generator and the second heat generator to shield the fixing rotator from the first heat generator and the second heat generator, the light shield movable to a shield position where the light shield shields a non-conveyance span of the fixing rotator in the axial direction thereof where the recording medium is not conveyed over the fixing rotator.

9. The fixing device according to claim 8, wherein the light shield includes a shield portion disposed opposite the non-conveyance span of the fixing rotator in the axial direction thereof where the recording medium is not conveyed over the fixing rotator, and wherein a shield portion of a reflector of the fixing device is in proximity to the shield portion of the light shield at the shield position and spans throughout an axial span of the light shield in the axial direction of the fixing rotator.

10. The fixing device according to claim 9, wherein the non-conveyance span of the fixing rotator in the axial direction thereof is outboard from a small recording medium conveyed over the fixing rotator.

11. The fixing device according to claim 10, wherein the small recording medium includes a postcard.

12. The fixing device according to claim 9, wherein an axial span of the shield portion of the reflector is not smaller than the axial span of the light shield in the axial direction of the fixing rotator.

13. The fixing device according to claim 1, further comprising a nip formation pad disposed inside the fixing rotator and pressing against the opposed rotator via the fixing rotator.

14. The fixing device according to claim 1, wherein the fixing rotator includes a flexible, endless belt.

15. The fixing device according to claim 1, wherein the opposed rotator includes a pressure roller.

16. The fixing device according to claim 1, further comprising a reflector interposed between the support and each of the first heat generator and the second heat generator to reflect light radiated from the first heat generator and the second heat generator toward the fixing rotator and extending in a direction perpendicular to the direction of rotation of the fixing rotator, the reflector including:

a body mounted on the support; and a shield portion projecting from the body toward the first heat generator and the second heat generator to shield the fixing rotator from the first heat generator and the second heat generator.

17. The fixing device according to claim 1, wherein the filament is coiled around a portion of the tungsten rod with a first spacing between coils of the filament, and the filament is coiled around another portion of the tungsten rod with a second spacing between the coils of the filament that is different than the first spacing.

18. An image forming apparatus comprising:

an image forming device to form a toner image; and a fixing device to fix the toner image on a recording medium, the fixing device including:

a fixing rotator rotatable in a predetermined direction of rotation;

a first heat generator disposed opposite the fixing rotator to heat the fixing rotator and spanning a first heating span in an axial direction of the fixing rotator;

a second heat generator disposed opposite the fixing rotator to heat the fixing rotator and spanning a second heating span in the axial direction of the fixing rotator that is different from the first heating span;

a support disposed inside the fixing rotator;

an opposed rotator contacting the fixing rotator to form a fixing nip therebetween, through which the recording medium bearing the toner image is conveyed; and an electric circuit disposed in at least one of the first heat generator and the second heat generator, the electric circuit including:

a filament; and a heat generation restrainer connected to the filament, the heat generation restrainer includes a tungsten rod, and the filament is coiled around the tungsten rod across an entire length of the tungsten rod in the axial direction.

19. A fixing device comprising:

a fixing rotator rotatable in a predetermined direction of rotation;

a first heat generator disposed opposite the fixing rotator to heat the fixing rotator and spanning a first heating span in an axial direction of the fixing rotator;

a second heat generator disposed opposite the fixing rotator to heat the fixing rotator and spanning a second heating span in the axial direction of the fixing rotator that is different from the first heating span;

a light shield interposed between the fixing rotator and each of the first heat generator and the second heat generator to shield the fixing rotator from the first heat generator and the second heat generator, the light shield movable to a shield position where the light shield shields a non-conveyance span of the fixing rotator in the axial direction thereof where a recording medium is not conveyed over the fixing rotator, and the light shield is rotatable in the direction of rotation of the fixing rotator;

a support disposed inside the fixing rotator;

an opposed rotator contacting the fixing rotator to form a fixing nip therebetween, through which the recording medium bearing a toner image is conveyed;

a reflector interposed between the support and each of the first heat generator and the second heat generator to reflect light radiated from the first heat generator and the second heat generator toward the fixing rotator and extending in a direction perpendicular to the direction of rotation of the fixing rotator, the reflector including:

a body mounted on the support; and a shield portion projecting from the body toward the first heat generator and the second heat generator to shield the fixing rotator from the first heat generator and the second heat generator;

an electric circuit connected to the first heat generator and the second heat generator; and a heat generation restrainer provided in the electric circuit to restrict heat generation in the electric circuit.

20. The fixing device according to claim 19, wherein the light shield includes a shield portion disposed opposite the non-conveyance span of the fixing rotator in the axial direction thereof where the recording medium is not conveyed over the fixing rotator, and wherein the shield portion of the reflector is in proximity to the shield portion of the light shield at the shield position and spans throughout an axial span of the light shield in the axial direction of the fixing rotator.

21. An image forming apparatus comprising the fixing device according to claim 19.

22. The fixing device according to claim 19, wherein the shield portion of the reflector is inclined with respect to the body toward the first heat generator and the second heat generator.

23. The fixing device according to claim 19, wherein the support includes a U-shaped structure and a projecting structure that extends from the U-shaped structure, and at least a part of the body is mounted on the projecting structure.

24. The fixing device according to claim 23, wherein the body includes an abutment portion that is parallel to the projecting structure and mounted on the projecting structure.

25. The fixing device according to claim 19, wherein the light shield includes an outboard portion and an inboard portion along the axial direction of the fixing rotator, and the outboard portion and the inboard portion together form a stepped structure.

* * * * *